United States Patent [19]

Galvin et al.

[11] 4,231,228

[45] Nov. 4, 1980

[54] COMBINATION PROCESS TUBE AND VIBRATION ATTENUATOR FOR A REFRIGERATION CIRCUIT

[75] Inventors: Michael E. Galvin, Clay; Robert J. Whitwell, Liverpool, both of N.Y.

[73] Assignee: Carrier Corporation, Syracuse, N.Y.

[21] Appl. No.: 63,623

[22] Filed: Aug. 3, 1979

[51] Int. Cl.[3] ..... F25B 45/00

[52] U.S. Cl. ..... 62/77; 62/292; 62/296; 62/298; 138/26; 417/312

[58] Field of Search ..... 138/26; 62/292, 296, 62/298, 77; 417/312

[56] References Cited

U.S. PATENT DOCUMENTS

| | | | |
|---|---|---|---|
| 2,010,546 | 8/1935 | Kenney | 62/115 |
| 2,702,993 | 3/1955 | Harris | 62/298 |
| 2,847,835 | 8/1958 | Cooper et al. | 62/292 |
| 3,154,245 | 10/1964 | Roelsgaard | 417/312 |
| 3,187,991 | 6/1965 | Roelsgaard | 417/312 |
| 3,187,992 | 6/1965 | Roelsgaard | 417/312 |
| 3,461,683 | 8/1969 | Valbjorn et al. | 62/295 |
| 3,826,870 | 7/1974 | Wurm et al. | 179/1 P |
| 3,926,009 | 12/1975 | Parker et al. | 62/296 |
| 4,043,432 | 8/1977 | Scheldorf | 138/26 |

*Primary Examiner*—Ronald C. Capossela

*Attorney, Agent, or Firm*—J. Raymond Curtin; Robert P. Hayter

[57] ABSTRACT

Apparatus and a method for providing a combination process tube for charging a refrigeration circuit and pressure variation attenuator for reducing pressure variations within the refrigeration circuit.

7 Claims, 2 Drawing Figures

COMBINATION PROCESS TUBE AND VIBRATION ATTENUATOR FOR A REFRIGERATION CIRCUIT

BACKGROUND OF THE INVENTION

1. Field of the Invention

The present invention relates to a refrigeration circuit and a method of reducing pressure variations therein. More particularly, the present invention concerns a tuned process tube such that the tube is utilized to attenuate vibrations during operation of a refrigeration circuit.

2. Description of the Prior Art

In a typical vapor compression refrigeration system various components such as a compressor, condenser, evaporator and expansion device are arranged to transfer heat energy between fluid in heat exchange relation with the evaporator and fluid in heat exchange relation with the condenser. Refrigerant lines are used to connect the components such that a closed refrigeration circuit having refrigerant circulating between the components is provided.

Upon initial manufacture of an air conditioning unit, it is necessary to charge the refrigeration circuit by removing water and non-condensable gases from the circuit and replacing same with a refrigerant, as is well known in the art. Many units have a process tube connected to a refrigerant line through which the unit is charged. Upon the charge of refrigerant being transferred to the refrigeration circuit the process tube is sealed such that a permanent joint is made assuring the integrity of the refrigeration circuit. This process tube has then served no other purpose.

In the herein described apparatus and method there is disclosed tuning this process tube by forming a crimp therein at a selected length from the joint with a refrigerant line such that a one-quarter wave length resonator is provided. Consequently, by selecting the appropriate length a vibration attenuation device is provided from a component previously only used for charging the refrigerant circuit upon manufacture. Prior art devices have included forming the lines of a refrigeration system with a plurality of bends such that pressure variations may be absorbed through these bends in the line. Additionally, convoluted flex pipe portions have been provided in a refrigerant line for a similar purpose. Additionally, the use of baffles and other add on or clamp on devices is well known in this art.

In a typical residential or room air conditioning unit a hermetic refrigerant compressor having an electric motor and a positive displacement compressor are sealed within a casing. The pulsating nature of a positive displacement compressor such as caused by pistons reciprocating back and forth creates vibrations. These vibrations may be transmitted either through refrigerant lines directly or through the refrigerant flowing through refrigeration circuit as pressure variations therein. The function of the present device is to attenuate pressure variations within the refrigerant. The vibrations created at the compressor not only serve to provide an additional stress to the components of the system but may also produce noise objectionable to the operator.

SUMMARY OF THE INVENTION

It is an object of the invention to provide a tuned process tube which not only serves as a device for charging a refrigeration circuit but further serves to attenuate pressure variations within the refrigerant of the circuit during unit operation.

A further object of the present invention is to provide a safe, economical, reliable, easy to manufacture and inexpensive sound attenuation device within an air conditioning unit.

These and other objects are achieved according to a preferred embodiment of the present invention wherein there is disclosed a process tube for charging a refrigeration circuit. This process tube is connected to a refrigerant line which serves to route refrigerant between the components of a vapor compression refrigeration system. During manufacture of the unit the refrigeration circuit is first evacuated and then has refrigerant conducted thereinto through the process tube. The process tube is sealed at a distance from the attachment of the tube to the refrigerant line, said distance being selected such that the process tube will serve as a sound attenuation device. The length of the process tube is selected to attenuate pressure variations within the refrigeration circuit of the frequency of vibration least desired.

DESCRIPTION OF THE PREFERRED EMBODIMENT

The embodiment described herein will be in conjunction with a room air conditioning unit adapted to be mounted in a window of a suitable enclosure to be conditioned. This invention applies likewise to refrigeration circuits in general, to other size air conditioning units and to refrigeration units which are assembled on the job site and to the several components of split systems which may be separately charged.

Figure 1:
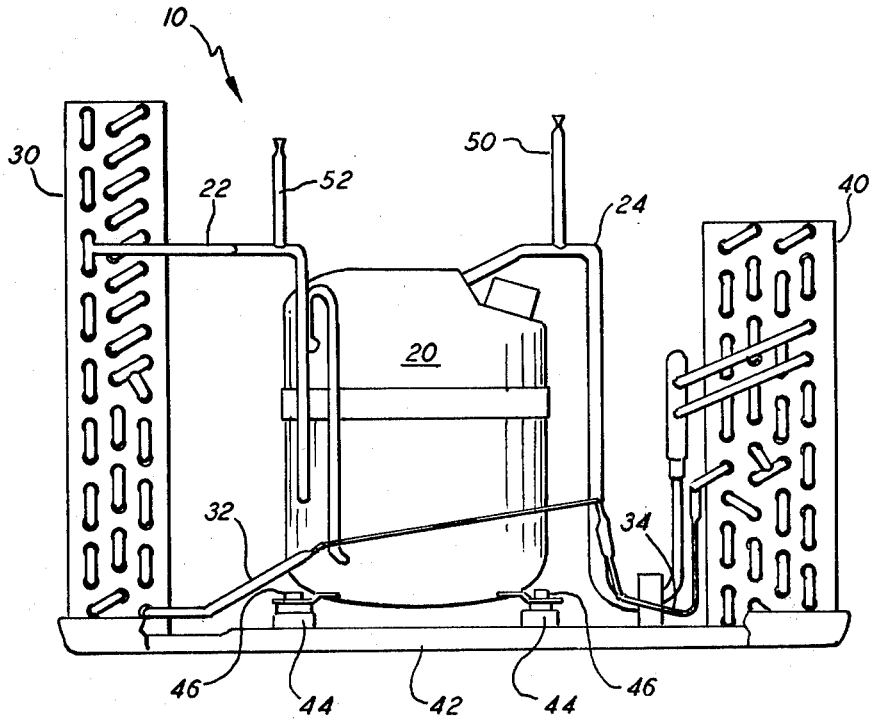
FIG. 1 is a schematic view of a vapor compression refrigeration circuit adapted for a room air conditioning unit having two process tubes.

Referring now to FIG. 1 it can be seen that the components of a vapor compression refrigeration circuit are mounted to base pan 42. Compressor 20 is connected by discharge line 22 to condenser 30. Liquid line 32 connects condenser 30 to capillary tube 34 which is connected to evaporator 40. Evaporator 40 is connected by suction line 24 back to compressor 20 to complete the circuit. Within compressor 20 refrigerant has its temperature and pressure increased and discharges a hot gas to condenser 30. Within condenser 30 refrigerant changes state to a liquid rejecting its heat of condensation to the heat transfer fluid in communication with the condenser. Liquid refrigerant then undergoes a decrease in pressure at the capillary tube or similar expansion device such that low pressure liquid enters the evaporator. The liquid refrigerant changes state to a gas in the evaporator absorbing its heat of vaporization from the fluid in communication with the evaporator and is thereafter conducted as a gas back to the compressor to complete the cycle.

In FIG. 1 compressor 20 is mounted to the base pan through grommets 44 by bolts 46. Process tube 50 is shown mounted to suction line 24 and process tube 52 is shown mounted to discharge line 22 of unit 10 as shown in FIG. 1. The particular number and location of process tubes are not critical to the present invention. Oftentimes a unit will have a process tube on both the high pressure side and low pressure side because it is difficult to force refrigerant or to withdraw existing fluid from the system through the pressure restrictive devices such as the compressor and the capillary tube. Other circuits may provide for two process tubes such that there is a tube to withdraw water and non-condensable gases from the circuit and a second tube to supply refrigerant thereto.

Figure 2:
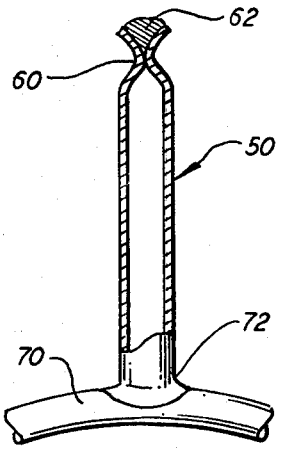
FIG. 2 is an enlarged partially cutaway view of a process tube connected to a refrigerant line.

In FIG. 2 it is seen that process tube 50 is secured to refrigerant line 70 with a saddle joint 72. Conventionally, the saddle joint is brazed or soldered to the refrigerant line to form an air-tight seal therewith. Process tube 50 has a crimped portion 60 located a predetermined distance L from saddle joint 72. This distance L is selected to be one-quarter of the wavelength of the frequency that it is desired to attenuate by the process tube. Crimp portion 60 is typically formed by mechanically deforming the tube inwardly to form a tight seal. Immediately adjacent thereto the end of the tube may be filled with solder 62 to form a permanent seal.

Some compressor manufacturers supply a process tube independent of the refrigerant circuit with the compressor. In such event usually only a single additional process tube is utilized on the discharge from the compressor. Oil may then be charged directly into the compressor process tube. Refrigerant may also be charged directly into the compressor process tube. By carefully selecting the location of the crimped portion in the joint it is possible to provide from a previously unused process tube a pressure variation attenuation device which may eliminate the need for a muffler or other attenuation device within the refrigeration circuit.

Upon assembly of an air conditioning unit a process tube is soldered to a refrigerant line. A hose is then connected to the process tube for both evacuating the refrigeration circuit and for charging the circuit with refrigerant. Thereafter the process tube is crimped at the appropriate length to form a resonator. The hoses are then removed and solder may be applied at the crimp to assure joint integrity.

While the invention has been described with reference to a particular embodiment it is to be understood by those skilled in the art that modifications and variations can be effected within the spirit and scope of the invention. It is further to be understood that although the preferred embodiment was described as an entire system utilization of a process tube as disclosed herein with the precharged component of a refrigeration circuit may serve the same function.

We claim:

1. A vapor compression refrigeration circuit having components including an evaporator, a condenser, a compressor and an expansion device which comprises:

a refrigerant line connecting at least two of said components, said line having a process opening therein; and means acting as a combination process tube and refrigerant pressure variation attenuator, said means being attached to the refrigerant line to be in communication with the refrigerant flowing therethrough via the process opening, said means being configured to attenuate pressure variations within the refrigerant flowing through the refrigeration circuit and said means further serving to provide apparatus for charging the refrigeration circuit with refrigerant.

2. The apparatus as set forth in claim 1 wherein the means acting as a combination process tube and refrigerant pressure variation absorber is a tube.

3. The apparatus as set forth in claim 2 wherein said tube has a crimped portion a selected distance from the refrigerant line to which it is attached whereby said tube serves as a one-quarter wavelength resonator.

4. The apparatus as set forth in claim 3 wherein the tube is attached to the refrigerant line with a brazed saddle type joint and wherein a portion of the tube located on the side of the crimped portion of the tube not in communication with the refrigerant is filled with solder.

5. A method of assemblying a machine having a refrigeration circuit which comprises the steps of:

mounting the components of a vapor compression refrigeration circuit in juxtaposition to each other connecting at least two of said components with a refrigerant line for conducting refrigerant therebetween forming an opening in the refrigerant line attaching a tube to the refrigerant line, said tube being in communication with the opening therein charging the refrigerant circuit through the tube, and sealing the tube a selected distance from the refrigerant line to prevent the further flow of refrigerant or other fluids therethrough and to provide a refrigerant pressure variation attenuator, the length between the refrigerant line and the portion where it is sealed being selected to serve as a one-quarter wavelength resonator for attenuating preselected frequencies of pressure variations within the refrigerant circuit.

6. The method as set forth in claim 5 wherein the step of sealing includes crimping the tube to prevent refrigerant flow therethrough and solderihg the crimped portion to assure that a tight seal is provided.

7. A combination process tube and resonator assembly comprising a component of a refrigeration circuit defining a flow path through which refrigerant may travel, said flow path having a process opening, and a tube attached to said flow path at the opening, said tube being sealed at a preselected length to act as a resonator for attenuating pressure variations within the fluid flowing through the flow path and prior to sealing said tube acting as a conduit to conduct refrigerant to the flow path of the component.

* * * * *